United States Patent [19]

Güntert et al.

[11] Patent Number: 4,811,716

[45] Date of Patent: Mar. 14, 1989

[54] FUEL INJECTION PUMP FOR INTERNAL COMBUSTION ENGINES

[75] Inventors: Josef Güntert, Gerlingen; Johann Warga, Bietigheim-Bissingen, both of Fed. Rep. of Germany

[73] Assignee: Robert Bosch GmbH, Stuttgart, Fed. Rep. of Germany

[21] Appl. No.: 104,027

[22] Filed: Oct. 5, 1987

[30] Foreign Application Priority Data

Oct. 4, 1986 [DE] Fed. Rep. of Germany ..... 3633899

[51] Int. Cl.[4] ..... F02M 39/00

[52] U.S. Cl. ..... 123/503; 123/500; 123/495; 417/289

[58] Field of Search ..... 123/503, 500, 495, 449, 123/501; 417/289

[56] References Cited

U.S. PATENT DOCUMENTS

| | | | |
|---|---|---|---|
| 4,445,828 | 5/1984 | Sontheimer . | |
| 4,587,940 | 5/1986 | Schmid | 123/503 |
| 4,630,586 | 12/1986 | Guntert | 123/503 |
| 4,661,051 | 4/1987 | Nakamura et al. | 417/499 |
| 4,705,005 | 10/1987 | Guntert | 123/503 |
| 4,706,626 | 11/1987 | Hafele | 123/503 |
| 4,721,442 | 1/1988 | Tanaka | 123/503 |
| 4,737,086 | 4/1988 | Yamaguchi | 123/503 |
| 4,754,737 | 7/1988 | Ishida | 123/500 |

FOREIGN PATENT DOCUMENTS

| | | |
|---|---|---|
| 3136751 | 3/1983 | Fed. Rep. of Germany . |
| 3540052 | 5/1986 | Fed. Rep. of Germany . |

*Primary Examiner*—Carl Stuart Miller
*Attorney, Agent, or Firm*—Edwin E. Greigg

[57] ABSTRACT

A fuel injection pump for internal combustion engines having at least one pump element comprising a housing, a cylinder liner in the housing, a pump piston operative in the cylinder liner, a recess in the cylinder liner having a radial entrance, for a control slide which controls injection onset during axial displacement on the pump piston. In the vicinity of the entrance to the recess which discharges into the pump work chamber, an apron is disposed on the control slide or on the cylinder liner, in order to cover a portion of a radial three-dimensional gap present between the control slide and the cylinder liner. By this means, the diverted fuel stream that is reflected by the side walls can be interrupted and reflected at least one additional time, so as thereby to reduce its kinetic energy.

6 Claims, 1 Drawing Sheet

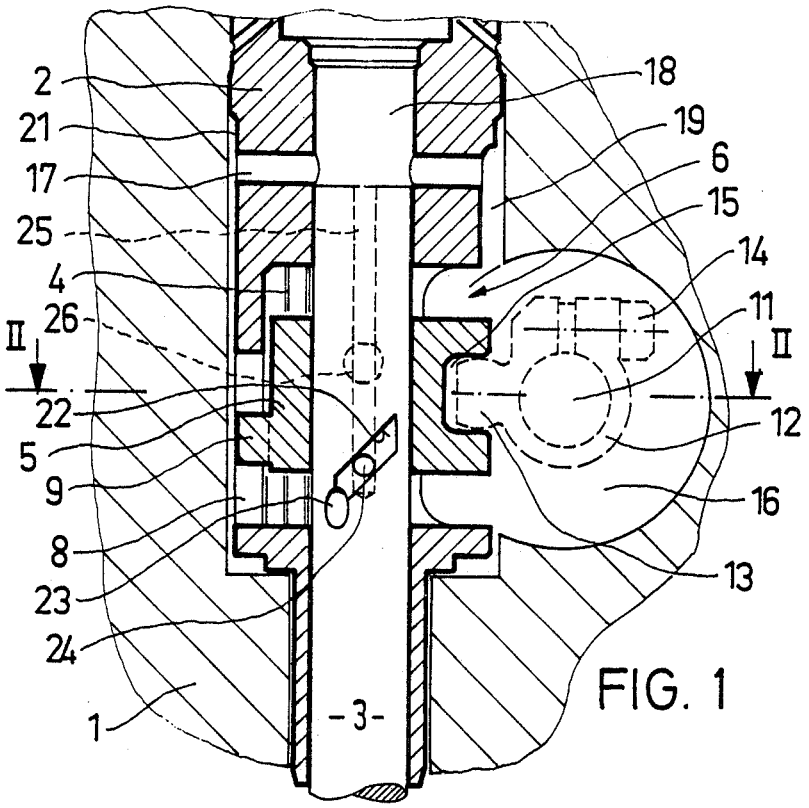
FIG. 1
FIG. 2
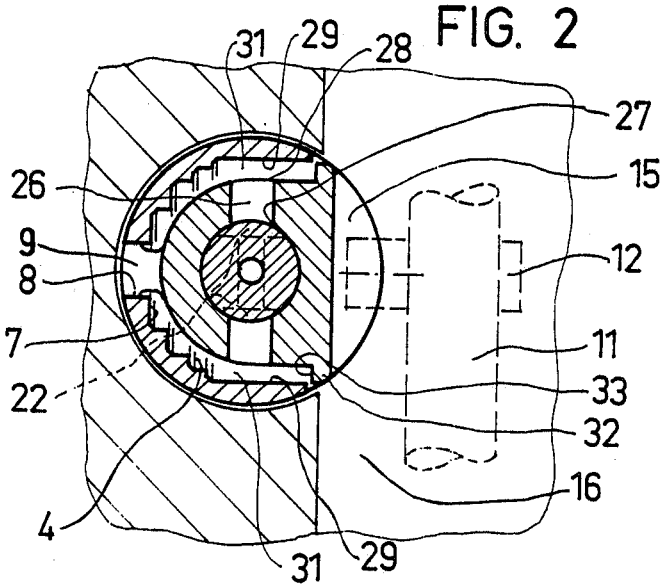

FUEL INJECTION PUMP FOR INTERNAL COMBUSTION ENGINES

BACKGROUND OF THE INVENTION

The invention is based on a fuel injection pump for internal combustion engines as generically defined hereinafter.

In slide-controlled fuel injection pumps of this type, the injection quantity and/or the injection onset is determined by the axial position of the control slide. There are also versions in which in addition to axial displacement, the control slide can also be rotated, to vary the fuel control in this way as well. In each case, however, the end of the high-pressure injection—which in terms of timing represents the end of injection, on the one hand, and on the other hand represents the end of high-pressure supply, determining the injection quantity—is determined by the uncovering of the control opening in the pump piston by the control slide, so that the fuel, which is at very high pressure, is diverted out of the pump work chamber via the relief conduit and the control opening into the recess of the cylinder liner. When diverted in this way, by means of a control edge of the control slide, the diverted fuel stream has extraordinarily high kinetic energy, which puts great strain on the materials on which the fuel stream impacts. Pressures in the pump work chamber can certainly be as high as 1300 bar. The energy losses between the pump work chamber and the diversion point are relatively slight, because upon diversion, the injection is abruptly interrupted, to assure fast nozzle needle closure.

In the control slide of a known fuel injection pump of this type (German Offenlegungsschrift No. 35 40 052) there is a radial diversion bore, which is uncovered, once the effective injection stroke has been executed, by an oblique control groove disposed as a control opening on the pump piston. At the time of diversion, the diverted stream shoots through this diversion opening onto the wall of the cylinder bushing recess. When the axial position of the control slide changes, the location of the diverted stream with respect to the point in the wall of the recess upon which the stream impacts changes as well. Since the wall is spaced apart from the mouth of the diversion bore only by the width of a gap, the stream is reflected from the wall into the gap and enters the suction chamber of the pump with very high energy.

This type of stream deflection has the disadvantage that the deflected stream, which still has very high kinetic energy, strikes the wall of the suction chamber—which like the entire pump housing is made of softer material, e.g., aluminum, than the pump cylinder liner and control slide, which are made of tempered steel. The result is cavitation and erosion damage to the suction chamber wall of the pump housing and to the control elements located in the suction chamber.

For in-line injection pumps, in which the diversion bore is always located at the same point, it is known (German Offenlegungsschrift No. 31 36 751) to provide an impact protection ring of tempered steel between the pump housing and the diversion bore. This kind of arrangement cannot be adopted for slide-controlled pumps, however, because the diversion bore shifts when the axial position of the control slide changes, and the gap between the control slide and the wall of the recess must always communicate, unthrottled, with the suction chamber, to prevent any undesirable effect on the fuel control during the intake stroke or even during the diversion. Also, an additional impact protection element would weaken the pump cylinder liner, or else the space required for the pump structure would have to be enlarged excessively.

OBJECT AND SUMMARY OF THE INVENTION

The fuel injection pump according to the invention, has the advantage over the prior art that the diverted stream is multiply reflected, namely from the wall of the recess onto the apron and from there back again, thus virtually dissipating the energy of the stream before the fuel flows over or under the apron to the suction chamber. One advantage of this is that the apron is axially displaced along with the control slide, and so a sufficiently large cross section is always available between the gap formed by the control slide and the recess and the suction chamber. In accordance with an advantageous feature of the invention, the control edge is embodied, in a manner known per se, by the entrance of at least one radial bore disposed in the control slide, for the sake of aiming the stream properly. The invention also applies, however, to types of diversion in which the control edge is disposed on any equivalent radial opening in the control slide, or is provided on the upper face end of the control slide, in which case the radial bore is then disposed in the pump piston.

In another feature of the invention, the control slide is guided to prevent rotation in the cylinder liner, so that the direction of diversion and hence of the reflected stream as well is always the same and can be predetermined.

In accordance with another feature of the invention, an entrance to the recess is provided radially, wtih respect to the cylinder axis, only on one side, so that the apron is also present only on one side, which is the side facing the suction chamber. The back wall of the recess, which is defined by the cylinder liner, is thus of tempered steel, so that the deflected stream that strikes it cannot do any damage.

According to the invention, the apron can have faces, extending at a right angle toward the gap, which are provided on shoulders with which the control slide is made wider. These shoulders can either plunge just inside the entrance to the recess, or can remain outside it; the only task these faces need to perform is to enable reflection of the fuel stream, for the sake of dissipating energy.

The invention will be better understood and further objects and advantages thereof will become more apparent from the ensuing detailed description of a preferred embodiment taken in conjunction with the drawings.

BRIEF DESCRIPTION OF THE DRAWINGS

FIG. 1 is a fragmentary view of a fuel injection pump according to the invention in longitudinal section; and FIG. 2 is a cross section taken along the line II—II of FIG. 1.

DESCRIPTION OF THE PREFERRED EMBODIMENT

In a pump housing 1, only part of which is shown, of a fuel injection pump, there is an inserted cylinder liner 2, in which a pump piston 3 is driven to reciprocate by means not shown. A recess 4 embodied in the manner of a blind opening is provided in the cylinder liner 2 and receives a control slide 5 that is axially displaceable on the pump piston 3. The recess 4 has an entrance 6, by way of which the control slide can be inserted. A lengthwise slit 8 in the back wall 7 of the recess is engaged by a protrusion 9 of the control slide 5, enabling the control slide 5 to execute an axial movement and securing it against rotation. The inner surface of the recess 4 of the cylinder liner between the slit 8 and a straight portion 29 is zig-zagged to form a greater spacing in parts of the recess from the control slide.

The axial actuation of the control slide 5 is effected via a rotatable governor rod 11. A driver lug 12 having a head 13 can be firmly fastened on the governor rod 11 by a screw 14 and thereby disposed adjustably in its rotational position, its head 13 being adapted to engage a transverse groove 15 of the control slide 5.

Preferably, a plurality of such pump elements 2, 3 having control slides 5 are disposed in line in the housing 1 of a fuel injection pump and are then operated in common by one governor rod 11, the drive lug 12 of which correspond in number to the number of pump elements. the governor rod 11 and driver lugs 12 are disposed in a pump suction chamber 16, which is supplied with fuel at low pressure in a manner not shown in detail via feed pump from a fuel tank. The entrance 6 to the recess 4 of the pump cylinder 2 is oriented toward this suction chamber 16, so that communication between the recess 4 and the suction chamber 16 is provided by an open V-shaped gap.

In the position shown, the pump piston 3 is assuming its bottom dead center position, in which it uncovers intake openings 17 of the pump work chamber 18, which communicate with the pump suction chamber 16 via a conduit 19 in the pump cylinder liner 2 or via a turned recess 21 [i.e., formed by turning, on a lathe] on the cylinder liner 2.

Located in the jacket face of the pump piston 3 are an oblique groove 22 and a recess 23, which are disposed in pairs as control openings on the pump piston 3 and communicate with one another via a transverse bore 24 that leads via a blind bore 25 to the pump work chamber 18. These control openings, namely the oblique grooves 22 and recesses 23, cooperate with two radial bores 26 of the control slide 5 that act as radial openings. The inlet edges 27 of these radial bores 26 serve as control edges toward the control openings, while the mouths 28 of these radial bores 26 are aimed at parallel side walls 29 of the recess 4.

The three-dimensional gaps 31 formed between the side walls 29 and the control slide 5 are covered, toward the suction chamber 16, by aprons 32 disposed on the control slide, which have faces 33 extending at right angles to the gap extension.

The operation of the exemplary embodiment shown is as follows:

In the bottom dead center position, shown, of the pump piston 3, the pump work chamber 18 is filled with fuel from the pump suction chamber 16 via the intake openings 17 and the conduit 19 or turned recess 21. Depending on the axial position of the control slide 5, part of the fuel supply can also be effected via the recesses 23 or oblique grooves 22, the transverse bore 24, and the blind bore 25. At the supply stroke of the pump piston 3, a portion of the fuel is first positively displaced back into the suction chamber 16, via the supply conduits, at least until such time as the intake openings 17 have been closed by the pump piston 3 and no longer than until the recesses 23 or oblique grooves 22 have also been covered by the control slide 5. From this supply stroke position on, the high pressure can build up in the pump work chamber 18 and the injection to the internal combustion engine can begin. This injection is then terminated whenever the control openings, namely the oblique grooves 22, come to coincide with the radial bores 26 of the control slide 5. The fuel, which is at very high pressure, is now pumped out of the pump work chamber 18 via the blind bore 25, the transverse bore 24, te oblique grooves 22 and the radial bore 26 into the three-dimensional gap 31, and the diverted fuel stream thereby formed strikes the opposite side walls 29. The stream is reflected at these side walls 29 and part of its strikes the back wall but the majority strokes the faces 33 of the apron 32, formed in the control slide or on the cylinder liner 2 at the recess 4 and after that flows into the remaining spaces in the recess 4 above and below the control slide 5. From there, the fuel then flows into the suction chamber 16.

The foregoing relates to a preferred exemplary embodiment of the invention, it being understood that other variants and embodiments thereof are possible within the spirit and scope of the invention, the latter being defined by the appended claims.

What is claimed and desired to be secured by letters patent of the United States is:

1. A fuel injection pump for internal combustion engines comprising a housing (1), a cylinder liner (2) in said housing, a piston (3) operative in said cylinder liner (2), a pump work chamber (18) formed by said cylinder liner and said pump piston, a control slide (5), surrounding a portion of pump piston (3) which serves to provide fuel control via a radial bore opening (26) having control edge (27) disposed in said control slide (5) and is axially displaceable in a recess (4) provided in the cylinder liner, a radial fuel flow entrance (6), is disposed in said recess (4), said recess forming a radial three-dimensional gap (31) for fuel guidance between the control slide (5) and a wall (29) of said recess (4);

a control opening including an oblique groove (22) and a recess (23) provided on a jacket face of the pump piston (3) which communicates with the pump work chamber (18) through a relief conduit (24, 25) extending in the pump piston (3), in which said control opening may be uncovered by the control slide (5) in order to terminate an injection, and which cooperates with said control edge (27) of the control slide (5) in such a way that a diverted stream strikes said wall (29) of the recess (4);

a pump suction chamber (16), disposed in the pump housing (1), into which chamber (16) said fuel flow entrance (6) of the recess (4) discharges, aprons (32) on the control slide in the vicinity of the entrance (6) of the recess (4) for at least partially covering said radial three-dimensional gaps which extend toward said pump suction chamber (16); and each of said aprons (32) have one face (33) extending at right angles toward said gap, said faces present on shoulders that widen said control slide (5) in the area of the gap.

2. A fuel injection pump as defined by claim 1, in which the control slide (5) is guided in a recess in the cylinder liner (2) and secured against rotation.

3. A fuel injection pump as defined by claim 1, in which said recess (4) includes two oppositely disposed parallel side walls (29) facing one another, and said radial bore openings are aimed at said side walls (29) in said recess.

4. A fuel injection pump as defined by claim 1, in which said recess (4) is embodied in the form of a blind bore and has only one entrance (6) extending radially with respect to the housing axis.

5. A fuel injection pump as defined by claim 2, in which said recess (4) is embodied in the form of a blind bore and has only one entrance (6) extending radially with respect to the housing axis.

6. A fuel injection pump as defined by claim 3, in which said recess (4) is embodied in the form of a blind bore and has only one entrance (6) extending radially with respect to the housing axis.

* * * * *